US006109658A

United States Patent [19]

Moore

[11] Patent Number: 6,109,658

[45] Date of Patent: Aug. 29, 2000

[54] BOOK HOLDER

[76] Inventor: Theodore W. Moore, 10403 N. 38th St., Phoenix, Ariz. 85028

[21] Appl. No.: 09/304,917

[22] Filed: May 4, 1999

Related U.S. Application Data

[60] Provisional application No. 60/095,910, Aug. 10, 1998.

[51] Int. Cl.[7] ..... B42D 9/00

[52] U.S. Cl. ..... 281/42; 24/67 R; 24/67.3; 281/45; 283/61

[58] Field of Search ..... 281/42, 45; 283/61, 283/62, 67 R; 24/67.3, 67.9, 336

[56] References Cited

U.S. PATENT DOCUMENTS

| | | | |
|---|---|---|---|
| D. 341,159 | 11/1993 | Watson et al. . | |
| 400,628 | 4/1889 | Ash . | |
| 606,924 | 7/1898 | Hale . | |
| 3,140,883 | 7/1964 | Anthony . | |
| 3,661,405 | 5/1972 | Brown | 281/42 |
| 3,701,332 | 10/1972 | Brooks | 281/42 |
| 4,474,383 | 10/1984 | Kikis . | |
| 5,165,722 | 11/1992 | Wong | 281/42 |
| 5,165,723 | 11/1992 | Evans . | |
| 5,246,251 | 9/1993 | Evans . | |
| 5,445,416 | 8/1995 | Zareck . | |
| 5,722,691 | 3/1998 | Patel | 281/42 |
| 5,797,631 | 8/1998 | Lander | 281/45 |
| 5,868,099 | 2/1999 | Begin | 281/42 |

FOREIGN PATENT DOCUMENTS

| | | |
|---|---|---|
| 10512 | of 1888 | United Kingdom . |
| 6537 | of 1895 | United Kingdom . |

*Primary Examiner*—Daniel W. Howell
*Assistant Examiner*—Monica Carter
*Attorney, Agent, or Firm*—Frank J. McGue

[57] ABSTRACT

A book holder is disclosed which addresses the unique and heretofore unresolved needs of readers of paperback pocketbooks. In its simplest form, the holder consists of two pieces interlocked so that they are capable of sliding lengthwise in relation to one another. One end of each piece is formed so that when the device is laid upon any flat surface and extended to its most open position, and open paperback pocketbook may be laid face up on top, then the device slid closed to such a position that the formed ends cup over the open pages on opposite sides, thus restraining same for easy viewing. The device includes a detent so as to prevent sliding out of the interlock and falling apart, yet this detent needs be such that it can be overcome with reasonable hand force to allow cleaning or removal of foreign objects.

16 Claims, 3 Drawing Sheets

BOOK HOLDER

RELATED APPLICATION

This is a continuation of provisional application Ser. No. 60/095,910 filed on Aug. 10, 1998.

FIELD OF THE INVENTION

This invention relates to book holders for holding open a book so as to facilitate reading of the pages of the book, and, more particularly, book holders for holding open paperback pocketbooks which present unique problems heretofore not resolved by prior art.

BACKGROUND OF THE INVENTION

A finely made, well bound book, unless subject to breezes, will lay flat when opened at any page without need for a holder of any kind. However, a need for a book holder arises from the closing pressure exerted by the binding in the spine of lesser quality books. Although hardcover books seldom snap shut, they often do flip over pages after opening when left unrestrained, thus losing the reader's place in the book.

Various prior art book holders have addressed this problem. For example, United Kingdom Patent No. 6,537 entitled "Improvements in Means for Holding Down the Leaves of Books During Use" filed in 1895 by Course discloses a means for holding down the leaves of books during use comprising a band of steel or any other suitable material long enough to reach from one side of the book to the other when the book is open, to be placed at the back of the book and to bend over the edges of both sides of the book until the ends come into contact with the leaves and thus hold them flat. Also provided is adjustment means to vary the width of the leaf holder.

U.S. Pat. No. 5,445,416 entitled "Book Holder" which issued on Aug. 29, 1995 to Zareck discloses a book holder that has flanges 24 and 26 which are transparent so the text can be read beneath them. The book holder of Zareck uses spring loaded arms beneath overhanging page retainers capable of accepting only a limited range of book width and thickness.

U.S. Pat. No. 5,165,723 entitled "Book Holder" which issued on Nov. 24, 1992 to Evans discloses a book holder in which the user bends the overhang portions 26AR and/or 26AL and 26BL so that the pages of the book are securely retained. However, this device is made of wire which is not adjustable as to width but only book thickness.

U.S. Pat. No. 606,924 entitled "Music Book Holder" which issued on Jul. 5, 1889 to Hale provides a music book holder in which the pages are held by pivoting levers 14. Hale employs a machined fixture whose width is adjustable by the interleaving two serrated bars and whose thickness is adjustable using spring loaded rocker arms requiring two-handed manipulation.

U.S. Pat. No. 5,246,251 entitled "Book Holder" which issued on Oct. 2, 1984 to Kikis shows an adjustable book holder with several embodiments. In one embodiment, Kikis discloses a book holder comprising clear plastic straps adjustable as to width in discrete settings by means of a metal rivet in one strap mating with discrete slots in the other strap. Kikis is capable of accepting various book thicknesses by means of C-shaped ends.

Although each foregoing patent discloses a book holder capable of performing its claimed function on books of other design, none function adequately for paperback pocketbooks due to their light weight, small size, fine print, narrow margins and stiff but fragile spines. The resultant problems presented by the combination of these realities has not been adequately addressed by any prior art.

Additionally, unlike shelved books, a high percentage of paperback pocketbooks are indeed transported in pockets, purses, backpacks, etc., where any accompanying book holder is subjected to conditions of pressure, distortion, abrasion, etc., that would either damage the book holder or cause the book itself or other nearby objects to be damaged by the book holder, or both.

What is needed, therefore, is a book holder which addresses all needs of the paperback pocketbook in a simple, light, rugged, affordable manner.

SUMMARY OF THE INVENTION

The book holder according to the present invention comprises two strips of ductile material strong enough to hold against the spine pressure of paperback pocketbooks, that pressure generally being well over one pound of force. The ductile material is bendable to allow adjustment for various book thicknesses as well as the normal gradual change of thickness right to left as a book is read. The ductile material is also durable, lightweight and economical.

The two strips are mutually interlocked, preferably via telescoping, so as to be extendible and retractable to accommodate various open book widths within a flat between opposing ends of each strip. The opposing ends are formed to rise above and over the left and right sides of the book. Each such opposing end overhangs and thereby captures the book pages securely yet with enough delicacy whereby each page can be easily extracted from the right side and inserted beneath the left side using only one finger.

A further element of the present invention is that words and letters are neither obscured nor shadowed by opaque materials of the device, nor distorted by parallax or shadowing caused by the thickness of a transparent material. This problem arise because of the small type (10 point is typical) and narrow margins (⅛" or less is common) used in most paperback pocketbooks. The present invention uses thin, tough but flexible transparent tips affixed to the overhanging ends. By considered geometry of angles, reach—and the natural tendency of open paperback pocketbooks to fan their pages in the constrained open position, this book holder allows unobscured reading of nearly all present paperback pocketbooks.

A further need of paperback pocketbooks is that as they are often carried stuffed into small and tight spaces, particularly when traveling, whereby a suitable book holder needs to be small, light, rugged and preferably attachable. In the present invention, the paperback pocketbook is closed and then rotated 90 degrees. By inserting the closed paperback pocketbook in the flat and springing the ends of the book holder over the top and bottom ends thereof, the present device is collapsed tight against the book—both of which my now be treated as a unit and stored, packed or transported as any paperback pocketbook.

As an accommodation to the rigors of transport and storage unique to paperback pocketbooks, this device can be pulled apart for cleaning or dislodging any foreign objects, then snapped together again without need of tools.

Also, an upper non-skid pad is affixed to the upper surface upon which the book rests so as to prevent the book sliding laterally as pages are turned. The pad should, at a minimum, engage the back cover which is the right side of an open book as read. This allows the user of the device the convenience of using it successfully whether or not the device is tightly closed to the page edges.

Lastly, preferably, a lower non-skid, non-scratch grip pad is affixed to the underside of the book holder since, due to the light weight of paperback pocketbooks, they will otherwise skid right-to-left as pages are turned. This also serves as an anti-scratch grip pad when placed on delicate surfaces.

DETAILED DESCRIPTION OF THE PREFERRED EMBODIMENT

Figure 1:
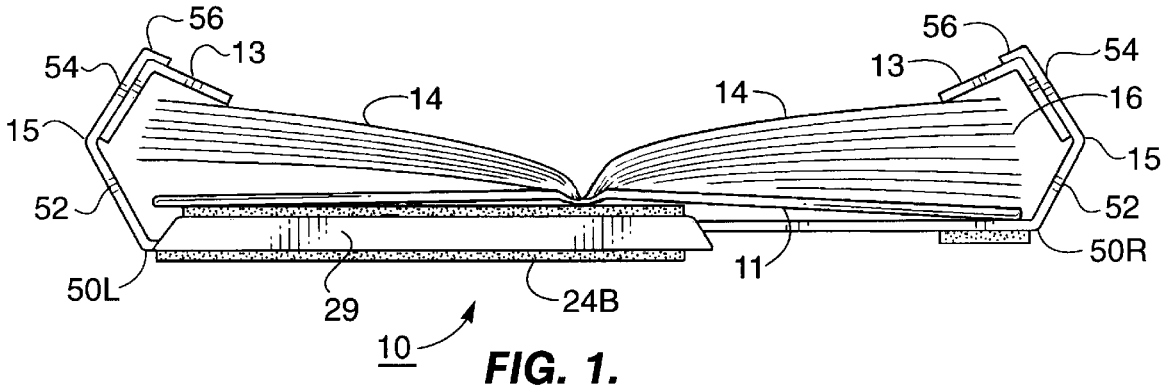
FIG. 1 is a side view of the book holder containing an open paperback pocketbook displaying typical usage.

Referring to the drawings, FIG. 1 shows a book holder 10 according to the present invention in operation in conjunction with a book 11. In FIG. 1, book holder 10 is shown in a closed position holding book 11. As shown, book holder 10 comprises two interlocking strips 50L and 50R. Book holder 10 maintains the closed position using friction between the two interlocking strips 50R and 50L. In addition, an anti-slip grip pad 24B is mounted beneath strip 50R.

Each strip 50 includes flat rectangular flat portions 17, each portion 17 having opposing stylized C-shapes 15 mounted at one end thereof. In the illustrated embodiment, relative to portions 17, each C-shape 15 comprises an outwardly and upwardly extending first portion 52, an inwardly and upwardly extending second portion 54 integrally attached to first portion 52 and a downwardly and inwardly extending third portion 56 integrally mounted to second portion 54. Mounted to each third portion 56 and extending inwardly and downwardly therefrom is an overhanging ear 13. Each ear 13 engages an exposed book page 14 by contact therewith.

As best seen in FIG. 1, underneath each exposed book page 14 is a typical book page fanout 16 created when a paperback pocketbook is laid flat. Book page fanout 16 extends underneath C-shape 15.

In the preferred embodiment, the angles formed between portions 52 and 54 and that formed between portion 52 and portion 17 is obtuse and is manually alterable which permits c-shapes 15 to accommodate variations in book thicknesses and change in thickness from left to right as reading progresses.

In addition to being manually alterable as described in the previous paragraph, C-shapes 15 are formed of a material which is rigid enough to capture and hold book fanout 16 securely therein but flexible enough to allow exposed page 14 to be easily extracted from the one C-shape 15 and inserted into the opposing C-shape 16, preferably using only one finger. The material must also have no latent memory so as to be adjustable to accommodate various thicknesses of books as well as the side to side thickness change as the book is read.

One suitable material is anodized aluminum while another is 0.020" thick brass sheet. Those skilled in the art will recognize that other materials having the above properties are suitable for use with this invention.

Figure 2:
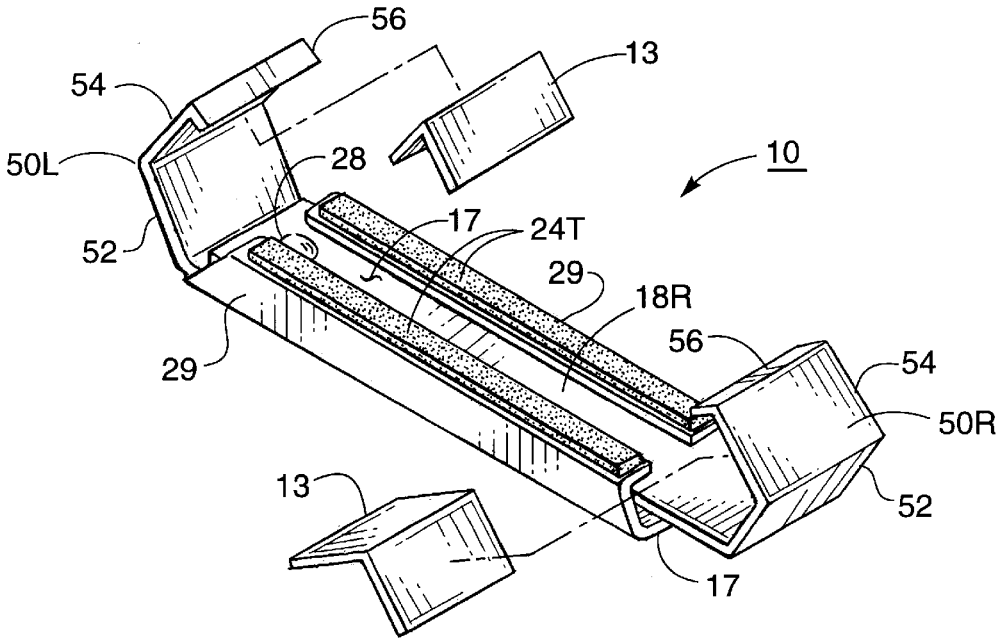
FIG. 2 is a partially exploded perspective view of the embodiment of FIG. 1 in a fully closed position.
Figure 4:
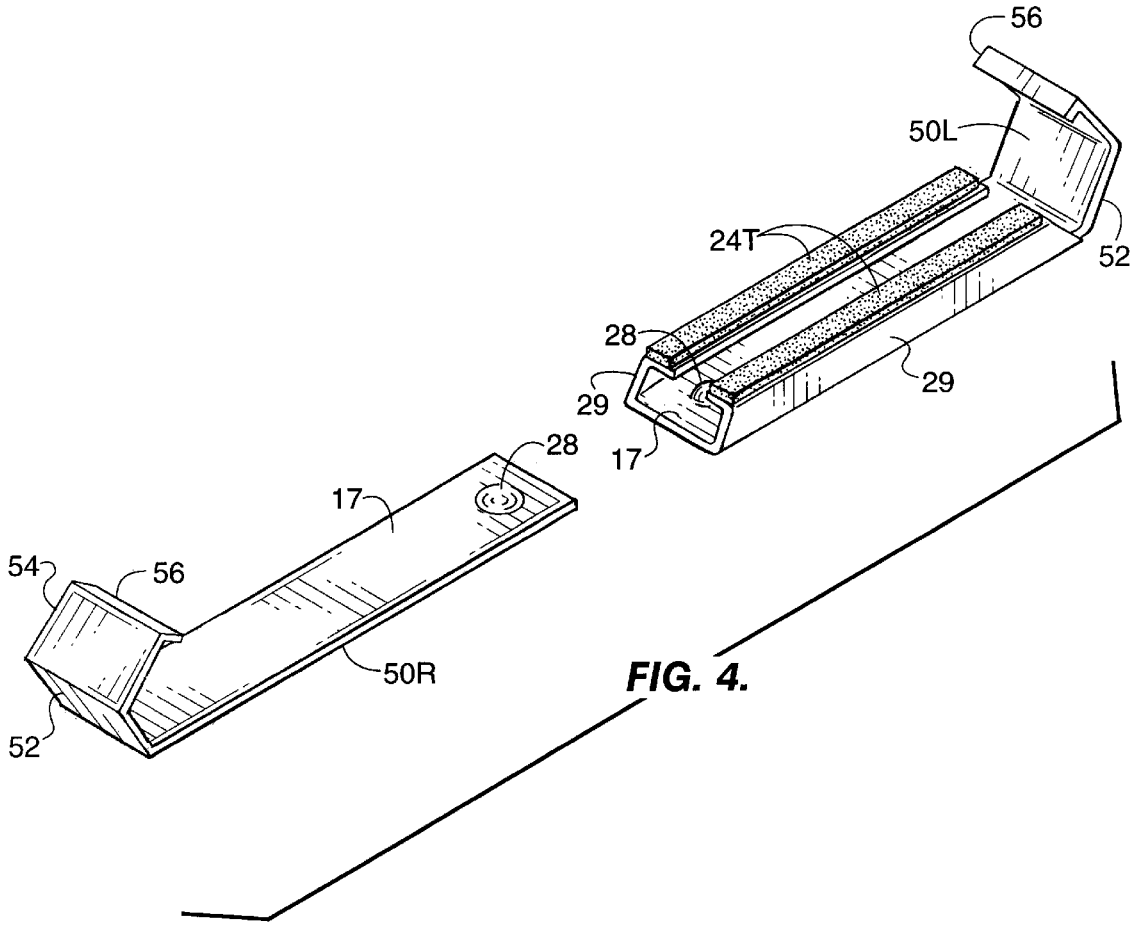
FIG. 4 is a exploded perspective of the present invention.

As best seen in FIGS. 2 and 4, strips 50 telescope into one another. In the preferred embodiment, strip 50R comprises only flat portion 17 while strip 50L has flat portion 17 plus folded over side rails 29 extending from opposing long sides of portion 17 and folding over the top thereof. Flat portion 17 of strip 50R is telescopically received between flat portion 17 and side rails 29 of strip 50L. In the preferred embodiment, side rails 29 are wide enough to constrain the flat portion 17 of strip 50R.

As best seen in FIG. 4, each portion 17 includes mating detents 28 at the end opposite c-shape 15. When strips 50 are slid apart, the sliding halts once detents 28 mate. However, when cleaning or removal of trapped particles is necessary, a sharp pull will spring the constraining detents 28 apart thereby allowing strips 50 to completely separate. Strips 50 may be rejoined by employing a sharp inward push.

In addition to preventing accidental separation of strips 50, detents 28 contacts the flat portion 17 of the opposing strip to offer sliding resistance to separation even when not mated with the other detent 28. The clearance left when bending side rails 29 and the depth of detent 28 determines the sliding resistance between strips 50. Altering the slide resistance can be accomplished by opening or closing slide rails 29. Such opening or closing is performed with any suitable tool such as a table knife or a flat rubberized shoe heel, respectively.

Figure 3:
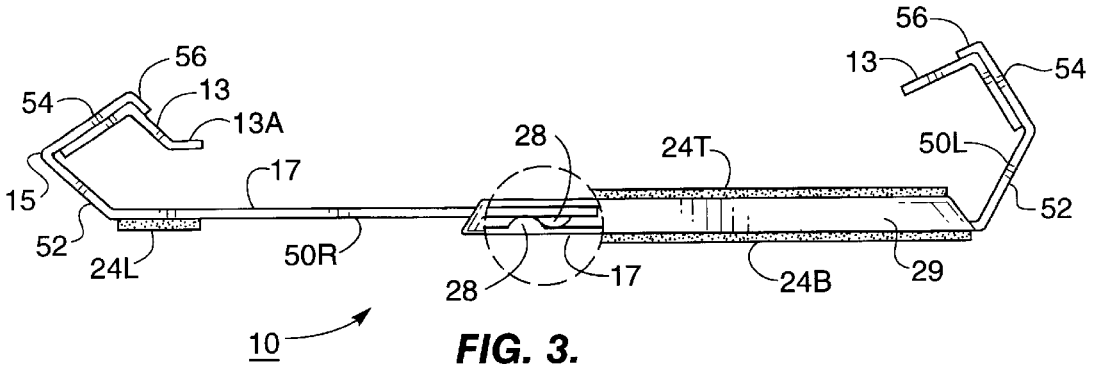
FIG. 3 is a partial cross sectional side view of the present invention in a fully opened position.

FIG. 3 shows a side view of the invention at fullest extension with a cutaway showing two detents 28 dimples engaged to stop further separation of strips 50. FIG. 3 also shows one c-shape 15 corresponding to strip 50R is bent to be lower than c-shape 15 corresponding to strip 50L. Such an arrangement corresponds to the starting a paperback pocketbook whereby only a few pages lie to that side. As reading proceeds the end pieces may be repositioned by bending as needed for ease of reading and ease of removal and insertion of pages.

For example, in the reading of a very thick (2–) paperback pocketbook at the start it may be necessary to change the angle between portions 52 and 54 to nearly 90 degrees relative to flat portion 17 on thick side while at the same time bending the opposing angle from obtuse to acute to minimize the distance between ear 13 and flat portion 17 on that side to capture exposed page 14 on the thin side. As discussed previously, the bending is easily accomplished manually without need of tools.

The transparent ears 13 comprise a thin, clear, flexible, durable and reasonably scratch resistant material. In placing book pages under ears 13, care must be taken to assure that words and/or letters are not obscured or distorted. This is difficult in the case of paperback pocketbooks as print is commonly 10 point type and is printed as close as ⅛" to the page edge, with ¼" being common. Compounding this difficulty is the strength of the bindings—exerting closing forces approaching four (4) pounds. Yet the spines are fragile as they are glued, not sewn, and so if flexed hard enough to reduce closing pressure will often crack and come apart.

To restrain this force against the narrow (4" typical width) pages of paperback pocketbooks requires an overreach of at least one inch. A lesser reach requires compensating downward force and produces pressure too high for easy removal and insertion of turning pages.

If more than ¼" of the overreach is opaque, letters are obscured. Even if wire as thin as 1/16" diameter is employed as the overreach restraint, 10 point type letters are approximately 1/16" in size and so are obscured. Further, any clear material not completely flat to the underlying page will cast a shadow with its edge. This shadow is magnified as height above page increases and darkened as lighting changes from diffuse daylight to single point reading light. In addition, any clear material will refract light across its thickness and result in dislocation of image whenever viewed through the edge. Any clear material rigid enough to be used for the entire body of the invention must be at minimum ⅛" thick for strength. This thickness, even 1/16", causes irritating dislocation of letters unless viewed perpendicular to the page which is awkward and impractical in most cases.

Even when used only for the overreaching portion of the invention, any rigid clear material thin enough to avoid the foregoing problems, would be too fragile for practical use. Therefore, this material needs to be thin (0.020" or less), and sufficiently flexible to restrain the open pages of a book while also allowing insertion of a turned page beneath the ear as well as durable and stiff enough to hold against spine force. The cold formable, glueable, stiff, clear, durable, economical 0.020" polycarbonate sheet is one plastic product which meets these needs. Those skilled in the art will recognize that other materials will meet these needs. A variation of ear 13 is shown in FIG. 3 in which the distal end 13*a* of the left ear 13 is upturned slightly. It has been found that this upturn facilitates insertion of the pages when said pages are being turned.

Mounted atop sliding rails 29 and underneath flat portion 17 of strip 50L are thin non-skid, non-slip grip pads 24T and 24B, respectively. Grip pad 24T is used to prevent skidding of book 11 while, for example, page turning. Grip pad 24B is used to prevent skidding of the entire book holder 10 and to protect any surface book holder 10 is resting thereon.

Figure 5:
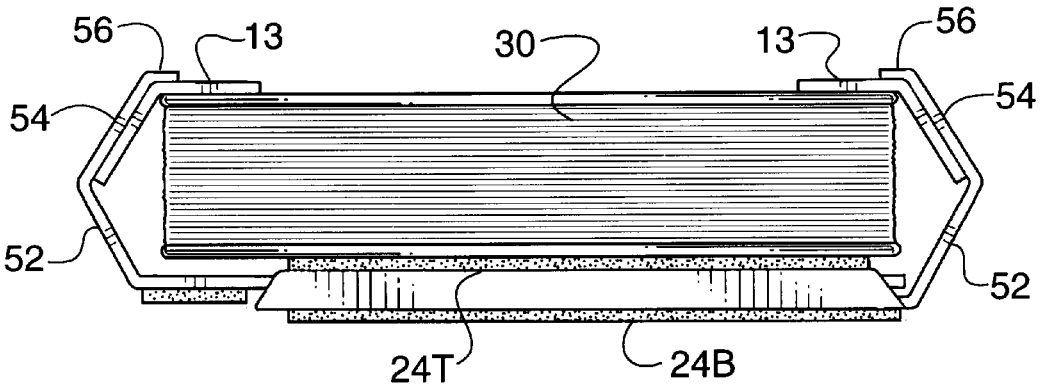
FIG. 5 is a side view of the invention in the closed position with a paperback pocketbook ready for storage and transportation.
Figure 6:
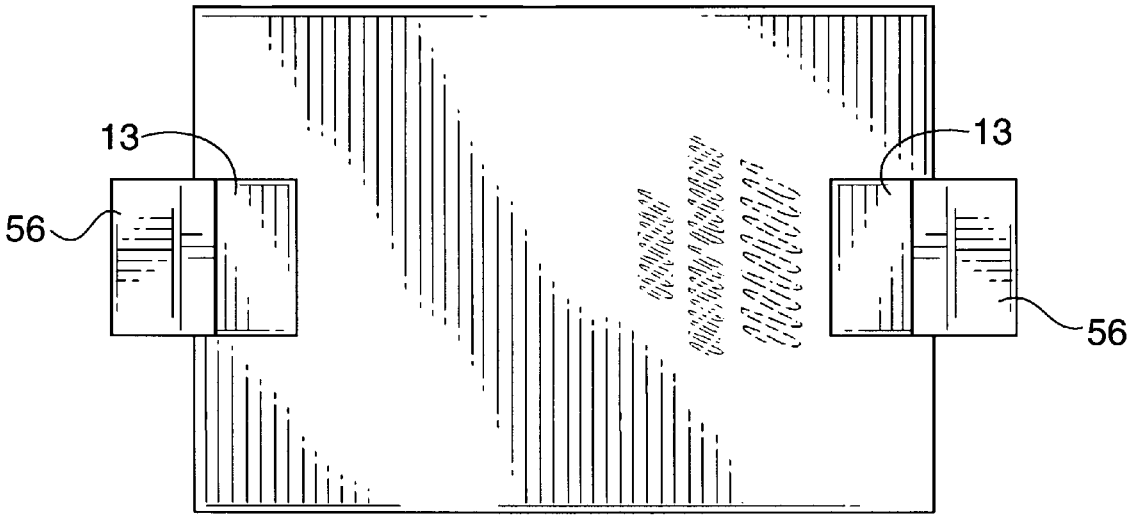
FIG. 6 is a top view of FIG. 5.

FIGS. 5 and 6 show a book holder 10 of the present invention in a closed position for transport, not reading. In this position book 11 is closed and rotated 90 degrees about a vertical axis from the reading position. Book 11 is laid flat upon grip pad 24T and book holder 10 is closed whereby C-shapes 15 engage book 11. In this position, book holder 10 holds book 11 firmly for transport and storage. Use in this manner takes up very little extra space as compared to the paperback pocketbook 11 itself.

Although only certain embodiments have been illustrated and described, it will be apparent to those skilled in the art that various changes and modifications may be made therein without departing from the spirit of the invention or from the scope of the appended claims.

That which is claimed is:

1. A book holder comprising two interlocking strips, each interlocking strip having a stylized C-shape mounted at one end thereof in opposition to the stylized C-shape of the other interlocking strip, the C-shape being formed of a material which is rigid enough to capture and hold a book fanout securely therein but flexible enough to allow an exposed page to be easily extracted from one of said C-shapes and inserted into the other of the C-shapes, the material having no latent memory so as to be adjustable to accommodate various thicknesses of books as well as the side to side thickness change as the book is read, one of the interlocking strips being telescopically received by the other of the interlocking strips, the interlocking strips having a fully closed position and at least one open position, the strips further having means for securing the strips in the closed position and the at least one open position, and an upper non-skid, non-slip grip pad mounted atop the interlocking strips thereby preventing skidding of a book held in the book holder and a lower non-skid, non-slip grip pad mounted underneath the interlocking strips, the lower grip pad preventing skidding of the book holder and protecting any surface the book holder is resting thereon.

2. The device of claim 1 wherein one of the interlocking strips comprises a first flat portion extending from the bottom of the C-shape of the one of the interlocking strips, the other of the interlocking strips comprising a second flat portion extending from the bottom of the C-shape of the other of the interlocking strips, the second flat portion having side rails extending laterally and upwardly therefrom, the side rails telescopically receiving the first flat portion, the side rails and the first flat portion having a slide resistance thereby holding the interlocking strips together.

3. The device of claim 2 wherein the means for securing the strips in the closed position and the at least one open position comprise mating detents in the first and second flat portions.

4. The device of claim 2 wherein the means for securing the strips in the closed position and the at least one open position comprises frictional engagement between the first and second flat portions.

5. The device of claim 2 further comprising means for altering the slide resistance between the side rails and the first flat portion.

6. The device of claim 5 wherein the means for altering the slide resistance comprises opening and closing the slide rails.

7. A book holder comprising two interlocking strips, each interlocking strip having a stylized C-shape mounted at one end thereof in opposition to the stylized C-shape of the other interlocking strip, the C-shape being formed of a material which is rigid enough to capture and hold a book fanout securely therein but flexible enough to allow an exposed page to be easily extracted from one of said C-shapes and inserted into the other of the C-shapes, the material having no latent memory so as to be adjustable to accommodate various thicknesses of books as well as the side to side thickness change as the book is read, each C-shape comprising an outwardly and upwardly extending first portion, an inwardly and upwardly extending second portion integrally attached to the first portion and a downwardly and inwardly extending third portion integrally mounted to the second portion, each C-shape further including an ear, the ear extending downwardly and inwardly from the third portion to engage the page of a book inserted and held between the opposing C-shapes, one of the interlocking strips being telescopically received by the other of the interlocking strips, the interlocking strips having a fully closed position and at least one open position, the strips further having means for securing the strips in the closed position and the at least one open position.

8. The device of claim 7 wherein the ear is a thin, clear, durable and scratch resistant material, the thin, clear, durable and scratch resistant material being sufficiently flexible to restrain the open pages of a book while also allowing insertion of a turned page beneath the ear.

9. The device of claim wherein the ear is 0.020" polycarbonate sheet.

10. The device of claim 7 wherein the first portion and the flat portion are disposed at an angle from each other, the angle being obtuse and manually alterable thereby permitting the C-shape to accommodate variations in book thicknesses and the change in thickness from left to right as reading progresses.

11. The device of claim 10 wherein the material is 0.020" thick brass sheet.

12. The device of claim 1 wherein the book holder in the closed position is sized to secure a closed book of a predetermined size therein.

13. A book holder comprising two interlocking strips, each interlocking strip having a stylized C-shape mounted at one end thereof in opposition to the stylized C-shape of the other interlocking strip, the C-shape being formed a material which is rigid enough to capture and hold a book fanout securely therein but flexible enough to allow an exposed page to be easily extracted from one of said C-shapes and inserted into the other of the C-shapes, each C-shape comprising;

an outwardly and upwardly extending first portion mounted to a flat portion at an angle, the angle between the first portion and the flat portion being obtuse and being manually alterable thereby permitting the C-shape to accommodate variations in book thicknesses and the change in thickness from left to right as reading progresses, an inwardly and upwardly extending second portion integrally attached to the first portion and a downwardly and inwardly extending third portion integrally mounted to the second portion, an ear extending downwardly and inwardly from the third portion to engage the page of a book inserted and held between the opposing C-shapes, the ear being a thin, clear, flexible, durable and scratch resistant material, one of the interlocking strips comprising a first flat portion extending from a bottom of the C-shape of the one of the interlocking strips, the other of the interlocking strips comprising a second flat portion extending from bottom of the C-shape of the other of the interlocking strips, the second flat portion having side rails extending laterally and upwardly therefrom, the side rails telescopically receiving the first flat portion, the side rails being manually adjustable to alter the slide resistance between the side rails and the first flat portion, the interlocking strips having a fully closed position and at least one open position, the strips further having mating detents in the first and second flat portions for securing the interlocking strips in the closed position and the at least one open position.

14. The device of claim 13 wherein the ear is 0.020" polycarbonate sheet.

15. The device of claim 13 wherein the material is 0.020" thick brass sheet.

16. The device of claim 13 further comprising an upper non-skid, non-slip grip pad mounted atop the interlocking strips thereby preventing skidding of a book held in the book holder and a lower non-skid, non-slip grip pad mounted underneath the interlocking strips, the lower grip pad preventing skidding of the book holder and protecting any surface the book holder is resting thereon.

* * * * *